United States Patent [19]

McAllister et al.

[11] Patent Number: 4,821,367

[45] Date of Patent: Apr. 18, 1989

[54] RECOVERY CHAMBER FOR SPRAY-TYPE VACUUM CLEANING APPARATUS

[75] Inventors: Tom A. McAllister, Mississauga; John S. McAllister, Pickering; William R. Bonnar, Whitby, all of Canada

[73] Assignee: American Home Products Corporation, New York, N.Y.

[21] Appl. No.: 187,316

[22] Filed: Apr. 28, 1988

[30] Foreign Application Priority Data

May 5, 1987 [CA] Canada ..... 536387

[51] Int. Cl.[4] ..... A47L 7/00

[52] U.S. Cl. ..... 15/353; 55/216

[58] Field of Search ..... 15/352, 353, 339; 55/216

[56] References Cited

U.S. PATENT DOCUMENTS

| | | | |
|---|---|---|---|
| 2,212,429 | 8/1940 | Yutzler | 55/216 |
| 2,989,769 | 6/1961 | Houser | 15/353 |
| 3,343,199 | 9/1967 | Nolte | 15/353 X |
| 4,088,462 | 5/1978 | Laule et al. | 15/353 X |

FOREIGN PATENT DOCUMENTS

| | | | |
|---|---|---|---|
| 3511574 | 10/1986 | German Democratic Rep. | 15/353 |

*Primary Examiner*—Chris K. Moore

*Attorney, Agent, or Firm*—Darby & Darby

[57] ABSTRACT

A recovery chamber for collection of dirt-laden fluid in a spray-type vacuum cleaning apparatus. The apparatus has a container for collection of the fluid, a vacuum source located at the bottom of the container and an open-ended riser tube centrally mounted in the container and connected in fluid-tight fashion to the vacuum source. The chamber includes an outer housing having a roof portion and an annular side portion. The housing is adapted to cover and be seated on the container. An inner chamber is included which has an annular wall affixed at its top portion to the underside of the roof portion of the outer housing. A fluid entry port is mounted on the side portion of the outer housing facing the annular wall of the inner chamber. The port is for connection to a hose and nozzle for dirt and fluid intake. A float mechanism is mounted on a lower portion of the inner chamber wall and alongside the riser tube. The float mechanism includes a float portion which extends into the container and is adapted to rise upon a rise in liquid level in the container. A vacuum cut-off device is attached to the float mechanism for covering the riser tube when the float mechanism rises an amount corresponding to a predetermined level of liquid in the container to prevent further vacuum action through the riser tube which, in turn, prevents further fluid from entering the container.

11 Claims, 2 Drawing Sheets

RECOVERY CHAMBER FOR SPRAY-TYPE VACUUM CLEANING APPARATUS

BACKGROUND OF THE INVENTION

A. Field of the Invention

The invention relates to suction-type or vacuum cleaning apparatus and, more particularly, to such apparatus which applies a liquid cleaner to a carpet or furniture to be cleaned immediately prior or simultaneously with application of suction from a vacuum source.

B. Background of the Prior Art

Apparatus for the vacuum extraction of liquid and dirt from an item to be cleaned are known. In such apparatus, a spray of liquid is imparted through a nozzle to an object to be cleaned (typically furniture or a carpet) and, at the same time, a vacuum is applied through the nozzle to suck up the applied liquid together with removed dirt. Such apparatus are known to include a recovery chamber connected to a vacuum source for receiving the extracted liquid and dirt. Such chambers may include a device which shuts off the vacuum to the recovery chamber when the liquid level reaches a predetermined height.

In Canadian Pat. No. 1,135,910, a recovery chamber is shown with a float having a gasket at the top. As the liquid level rises, the float will rise to a point where the suction provided at an inlet end 52 will cause the float and gasket to close the inlet end. Since this arrangement relies on a substantial degree of suction to effectuate cut-off, in a situation where there is reduced suction for whatever reason, cut-off may not occur early enough. Further, if there is substantial foaming, the foam may enter the near horizontally arranged inlet 52.

Canadian Pat. No. 1,045,315 discloses two different cut-off arrangements in a recovery chamber wherein a float mechanism cuts off vacuum flow by closing a pair of holes which allow vacuum to enter a vacuum chamber. These arrangements were designed to avoid high foam build-up, however, these arrangements are structurally complicated and will require a greater than usual vacuum requirement. Further, since currently used cleaning solutions for such apparatus employ desudsing agents which prevent such build-up, this type of structure is not designed for current conditions.

SUMMARY OF THE INVENTION

An object of the present invention is to provide a design for a recovery chamber in a spray-type vacuum cleaning apparatus which overcomes various deficiencies of prior art apparatus.

It is another object of the present invention to provide a recovery chamber in a spray-type vacuum cleaning apparatus which has a positive suction cut-off at a predetermined level of liquid recovery.

It is yet another object of the present invention to provide a recovery chamber in a spray-type vacuum cleaning apparatus in which the liquid recovery is visible during operation.

It is still another object of the present invention to provide a recovery chamber for a spray-type vacuum cleaning apparatus which has a relatively small number of parts and is relatively compact so as to allow for greater liquid recovery.

In accordance with the present invention, in a spray-type vacuum cleaning apparatus having a container for collection of dirt-laden fluid, a vacuum source located at the bottom of the container and an open-ended riser tube centrally mounted in the container and connected in fluid-tight fashion to the vacuum source, the improvement comprising a recovery chamber, the recovery chamber including an outer housing having a roof portion and a side portion. The housing is adapted to cover and be seated on the container. Also included is an inner chamber having a peripheral wall affixed at its top portion to the underside of the roof portion of the outer housing. A fluid entry port is mounted in the side portion of the outer housing; the port faces the peripheral wall of the inner chamber. The port is for connection to a hose and nozzle for dirt and fluid intake. A float mechanism is mounted on a lower portion of the inner chamber wall and alongside the riser tube. The float mechanism includes a float portion which extends into the container and is adapted to rise upon a rise in liquid level in the container. Vacuum cut-off means are attached to the float mechanism for covering the riser tube when the float mechanism rises an amount corresponding to a predetermined level of liquid in the container to prevent further vacuum action through the riser tube which, in turn, prevents further fluid from entering the container.

For a better understanding of the present invention, reference is made to the following description and accompanying drawings, while the scope of the present invention will be pointed out in the appended claims.

DESCRIPTION OF THE PREFERRED EMBODIMENTS

Figure 1:
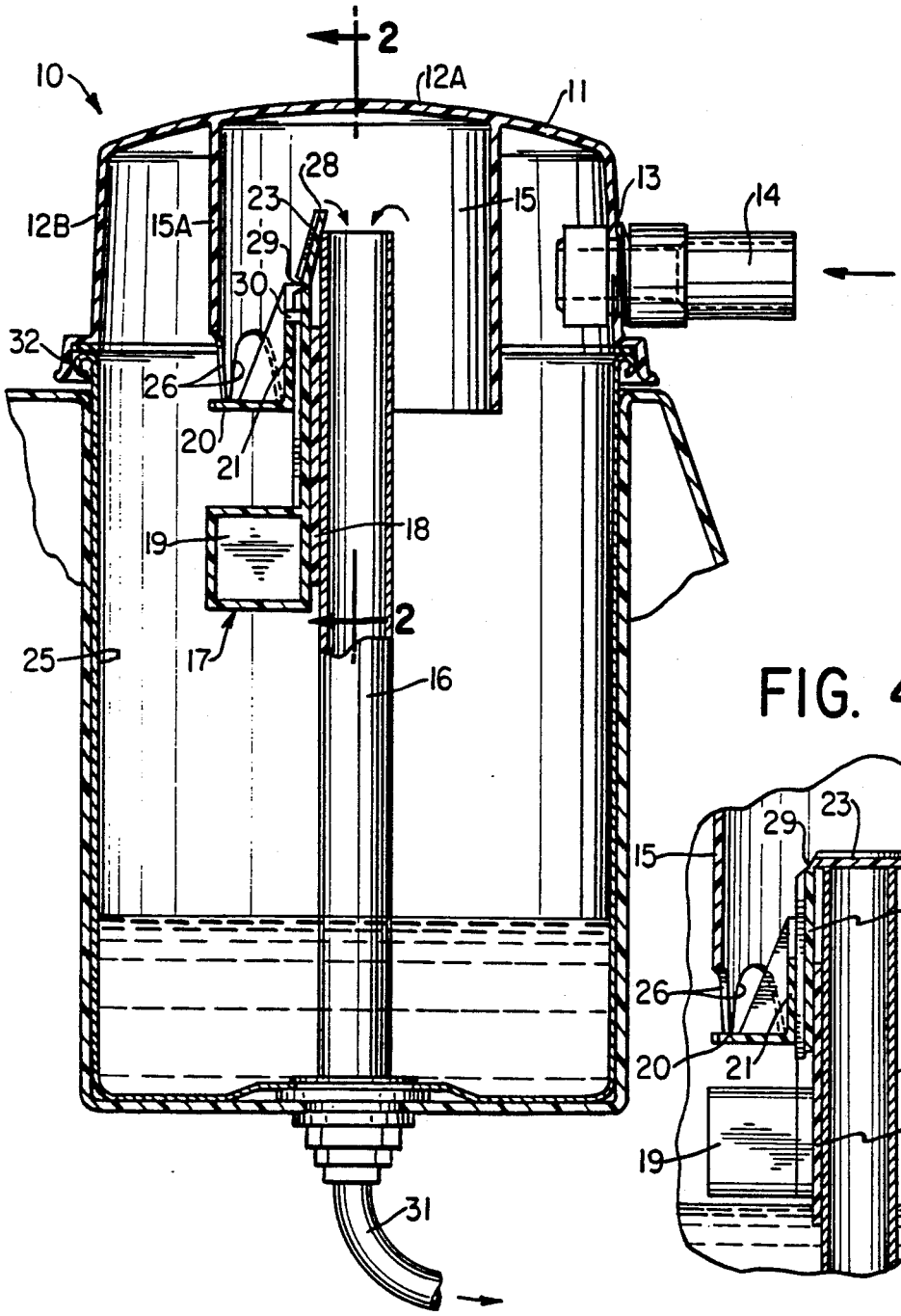
FIG. 1 represents a cross-sectional side view of the recovery chamber in accordance with the present invention taken along the line 1—1 of FIG. 2.

Referring initially to FIG. 1, shown there is a recovery chamber 10 for a spray-type vacuum cleaning apparatus in accordance with the present invention. The chamber 10 includes a dome-shaped, outer housing 11 which has a roof portion 12A and an annular peripheral side portion 12B. A fluid entry port 14 is mounted in the side portion 12B of the housing at mounting 13. The fluid entry port 14 is connected to a vacuum hose and nozzle for sucking in dirt-laden liquid.

The recovery chamber 10 is seated on the top of the outer wall of container 25. At the bottom of container 25, a source for a vacuum is provided. A riser tube 16 is mounted centrally within the container 25, the bottom of the riser tube being connected to the vacuum source 31 in fluid-tight fashion. The top of the riser tube extends into the recovery chamber and is open to provide a suction to the recovery chamber. The bottom of the side portion of the recovery chamber 10 is fitted with a gasket 32 to provide a vacuum-tight seal with the top of the container 25.

Within the outer housing 11 is an inner chamber 15 which includes an annular wall 15A affixed to the roof portion 12A of the outer housing. The fluid entry port 14 faces the annular wall of the inner chamber which blocks the fluid and sends most of it down into the container. To the extent that any fluid is drawn laterally, baffles 27 affixed to the inside of the side portions of the outer housing and the outside of the annular wall of the inner chamber serve to block the laterally transmitted fluid which then drops down into the container. The inner chamber 15 also has vacuum ports 26 to equalize pressure throughout the recovery chamber to eliminate any tendency for moisture to condense locally.

A float mechanism 17 is mounted on a lower portion of the inner chamber wall adjacent the riser tube. The float mechanism includes vacuum cut TM off means, shown as hinged flapper unit 23, for covering the riser tube when the float mechanism rises an amount corresponding to a predetermined level of liquid in the container to prevent further vacuum action through the riser tube. This, in turn, prevents further fluid from entering the container.

The float mechanism 17 includes a float guard 18 shown as a vertical plate and a float portion 19. A cross support 20, affixed to the wall 15A of the inner chamber, supports a float guide 21. The float guard 18 is mounted to the guide 21 which is shaped to provide a narrow space therebetween. An elongated bar 22 is mounted for vertical movement within the narrow space defined by the float guide 21 and the float guard 18. The elongated bar 22 includes a stop 30 (FIG. 2) which cooperates with the top of the float guard 18 for preventing the lowering of the bar below a certain point.

Figure 2:
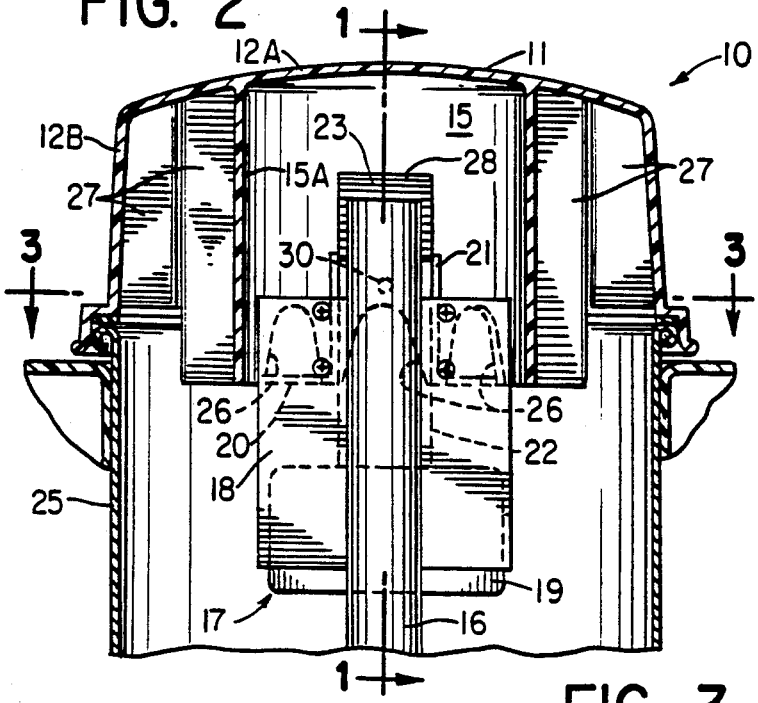
FIG. 2 illustrates a partial cross-sectional view along the line 2—2 of FIG. 1 of the recovery chamber.
Figure 3:
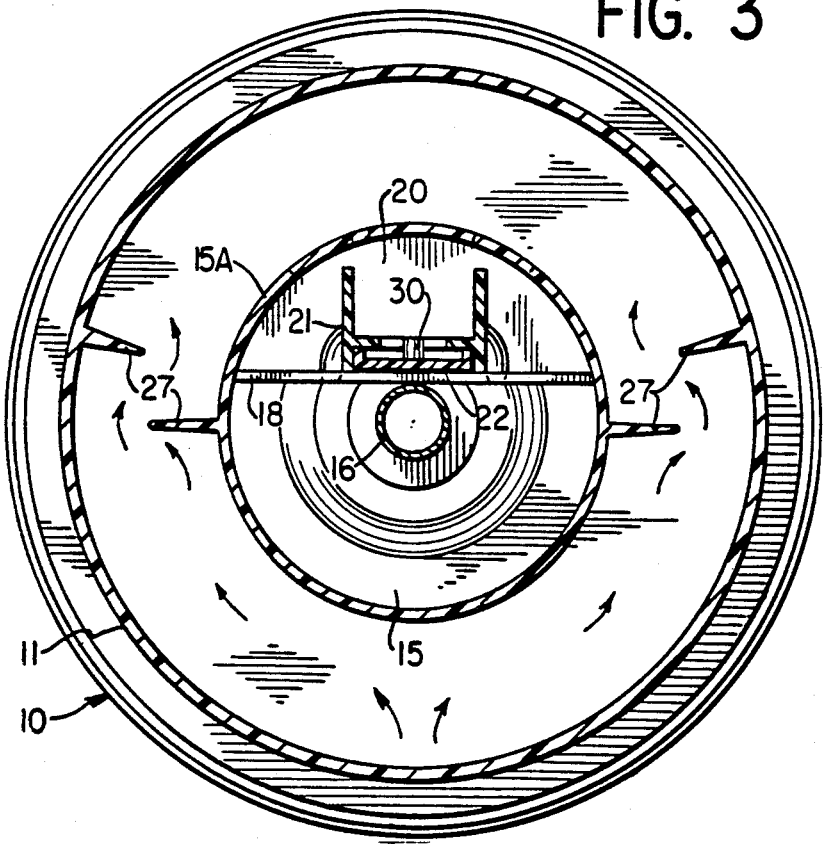
FIG. 3 is a plan sectional view of the recovery chamber of the invention along line 3—3 of FIG. 2.

The hinged flapper unit 23 includes the hinge area 29 and the end portion 28. FIG. 2 illustrates the preferred arrangement of the vacuum ports which are disposed in the wall of the inner chamber away from the fluid entry port. FIG. 3 illustrates the location of the vacuum ports as well as the preferred location of the baffles 27.

Figure 4:
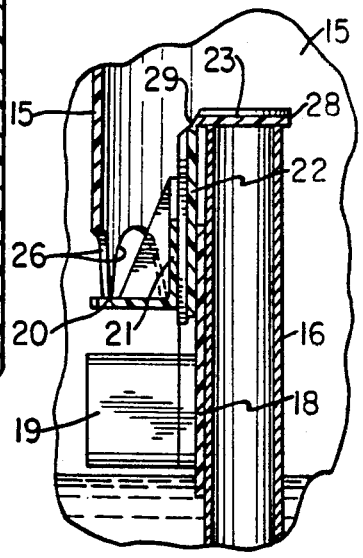
FIG. 4 illustrates a more detailed view of the float mechanism in a closed condition of the riser tube of the recovery chamber of the present invention.

FIG. 4 illustrates in detail the position of the float mechanism when the flapper unit closes the riser tube. It should be noted that the hinge area 29 is preferably formed by partially cutting through an elongated plastic bar; the lower part thus becomes elongated bar 22 and the upper part becomes the extension piece or flapper 28.

In operation, when there is little or no liquid in the container (see FIG. 1), the float mechanism 17 is at the bottom of its travel, retained there by stop 30. In this condition, the extension piece is roughly parallel to and supported by the riser tube. As the liquid level in the container rises, so will the float mechanism until the hinge area 29 is about as high as the riser tube itself. At this point, the extension piece 28 will fall so as to cover the riser tube (see FIG. 4). The suction afforded by the riser tube will accelerate this action.

In a preferred arrangement, the outer housing 11 and inner chamber 15 of the recovery chamber 10 are constructed of transparent plastic material to allow the fluid collection process of the recovery chamber to be observed.

While the foregoing description and drawings represent the preferred embodiments of the present invention, it will be obvious to those skilled in the art that various changes and modifications may be made therein without departing from the true spirit and scope of the claims.

What is claimed is:

1. In a spray-type vacuum cleaning apparatus having a container for collection of dirt-laden fluid, a vacuum source located at the bottom of the container and an open-ended riser tube centrally mounted in the container and connected in fluid-tight fashion to the vacuum source, the improvement comprising a recovery chamber, said recovery chamber including:

an outer housing including a roof portion and a side portion, said housing adapted to cover and be seated on the container;

an inner chamber having a peripheral wall affixed at its top portion to the underside of the roof portion of said outer housing;

a fluid entry port mounted in the side portion of said outer housing, said port facing the peripheral wall of the inner chamber, said port for connection to a hose and nozzle for dirt and fluid intake;

a float mechanism mounted on a lower portion of said inner chamber wall and alongside said riser tube, said float mechanism including a float portion which extends into the container and is adapted to rise upon a rise in liquid level in said container; and vacuum cut-off means attached to said float mechanism for covering said riser tube when said float mechanism rises an amount corresponding to a predetermined level of liquid in the container to prevent further vacuum action through said riser tube which, in turn, prevents further fluid from entering the container.

2. The apparatus of claim 1, wherein said vacuum cut-off means includes a hinged flapper unit affixed to the top portion of said float mechanism, said flapper unit having an end portion which is parallel to and is supported by the riser tube when the liquid in the container is below a predetermined level, said flapper unit rising with the float mechanism upon a rise in liquid level in the container, said flapper unit end portion being constructed to fall when said float mechanism rises an amount corresponding to a predetermined level of liquid in the container to cover said riser tube.

3. The apparatus of claim 2, wherein said float mechanism includes a cross support affixed to said inner chamber wall;

a vertical plate affixed to a side portion of said cross support;

guide means mounted on an upper surface of said cross support;

an elongated bar mounted for vertical movement within a space defined by said guide means and plate, said bar having a float affixed to its lower end and a stop on an upper portion thereof for cooperation with the top of said plate to prevent descent of said bar below a certain point; and said bar having an extension piece hinged to the top end of the bar, said bar and extension piece forming said flapper unit.

4. The apparatus of claim 3, wherein said bar and extension piece are formed from a single bar of plastic, said hinge being created by a partial cut through said plastic.

5. The apparatus of claim 3 wherein said bar and extension piece are formed from a single bar, said hinge being created by a partial cut through said bar.

6. The apparatus of claim 1, wherein said peripheral wall of said inner chamber includes at least one opening in a portion of the wall not exposed to fluid from said fluid entry port, said opening being for vacuum equalization throughout the recovery chamber in order to prevent condensation.

7. The apparatus of claim 1, wherein the riser tube extends into the inner chamber.

8. The apparatus of claim 1, wherein said outer housing and inner chamber are composed of a transparent plastic to allow for examination of the liquid entering the container.

9. The apparatus of claim 1, wherein the outer housing seats on the container with a fluid-tight seal.

10. The apparatus of claim 1 including baffle projections extending from inner portions of the housing and the outer portions of the inner chamber wall to prevent fluid flow laterally in the recovery chamber.

11. The apparatus of claim 1, wherein said outer housing and inner chamber are composed of a transparent material to allow for examination of the liquid entering the container.

* * * * *